US006169221B1

(12) United States Patent
Milner et al.

(10) Patent No.: US 6,169,221 B1
(45) Date of Patent: Jan. 2, 2001

(54) DECONTAMINATION OF METAL

(75) Inventors: Timothy Nicholas Milner; Alexander Hamilton Smith; Neil Graham Smart, all of Seascale (GB)

(73) Assignee: British Nuclear Fuels plc(GB)

( * ) Notice: Under 35 U.S.C. 154(b), the term of this patent shall be extended for 0 days.

(21) Appl. No.: 09/194,461

(22) PCT Filed: May 19, 1997

(86) PCT No.: PCT/GB97/01379

§ 371 Date: Jun. 28, 1999

§ 102(e) Date: Jun. 28, 1999

(87) PCT Pub. No.: WO97/44793

PCT Pub. Date: Nov. 27, 1997

(30) Foreign Application Priority Data

May 21, 1996 (GB) ..... 9610647

(51) Int. Cl.[7] ..... G21F 9/00

(52) U.S. Cl. ..... 588/18; 423/18; 423/20; 134/3

(58) Field of Search ..... 588/18; 423/18, 423/20; 134/3

(56) References Cited

U.S. PATENT DOCUMENTS

| | | | | |
|---|---|---|---|---|
| 3,258,429 | | 6/1966 | Weed | 252/301.1 |
| 4,452,643 | | 6/1984 | Martin et al. | 134/3 |
| 4,508,641 | * | 4/1985 | Hanulik . | |
| 4,512,921 | * | 4/1985 | Anstine et al. . | |
| 4,587,043 | * | 5/1986 | Murray et al. . | |
| 4,971,625 | | 11/1990 | Bahr | 75/118 R |

FOREIGN PATENT DOCUMENTS

| | | | |
|---|---|---|---|
| 2 284702 | 6/1995 | (GB) | G21F 9/28 |
| 59-035029 | 2/1984 | (JP) | C01G 25/02 |

OTHER PUBLICATIONS

Mamaev et al.; Possibility of Using Oxalic Acid Solutions for Decontaminating the Coolant Circuit of the RBMK–1000 (Reactor), Soviet Atomic Energy 49:3 637–641 (1980) XP002038963 (see abstract).

* cited by examiner

*Primary Examiner*—Ngoclan Mai
(74) *Attorney, Agent, or Firm*—Myers Bigel Sibley & Sajovec, P.A.

(57) ABSTRACT

A process for the decontamination of radioactively contaminated metal which comprises contacting the metal with a decontamination reagent solution containing an organic acid and an oxidising agent, allowing said solution to react with the contaminated metal at a pH of up to 4.5, treating the resulting solution to cause substantially complete precipitation of dissolved metal together with radionuclides and separating precipitated material, containing radioactive contaminants, from said solution.

14 Claims, No Drawings

DECONTAMINATION OF METAL

FIELD OF THE INVENTION

The present invention relates to the decontamination of radioactive metal surfaces making use of aqueous solutions containing organic acids.

BACKGROUND OF THE INVENTION

Many methods are known for the decontamination of radioactive metal surfaces. Some of these known methods make use of aqueous solutions containing organic acids.

U.S. Pat. No. 4,508,641 proposes a method using formic acid and/or acetic acid as a decontamination agent in the presence of at least one reducing agent, such as formaldehyde and/or acetaldehyde. The addition of a reducing agent causes the iron ions to remain stable in the solution, the iron compounds only being separated from the decontamination solution in a second step of the overall process.

U.S. Pat. No. 5,386,078 discloses a process for decontamination of radioactively contaminated metallic objects in which the objects are contacted with an aqueous solution containing formic acid. The concentration of formic acid is from 0.05% to 5.0% by volume. The contact between the solution and the metal object is maintained until the formic acid is nearly completely stoichiometrically depleted. This procedure is repeated until the radioactively contaminated metal object has a residual radioactivity level below a permissible threshold level. A radioactive sediment is then formed by sedimenting out metallic oxides and metallic hydroxides from the aqueous solution.

GB-A-2284702 discloses a process for the decontamination of a metallic material in which the material is contacted with a solution comprising an organic acid and the resultant metal organic compound is oxidised to form a precipitate with which the contaminants are associated. The organic acid may be formic acid, acetic acid, trifluoroacetic, citric acid or oxalic acid.

The oxidation may take place at the same time as the contaminated metal dissolution to assist the kinetics of the process and may be effected by use of a chemical oxidising agent, for instance, potassium permanganate or a peroxide such as hydrogen peroxide or by an electrochemical process. The process could be carried out with a weak organic acid solution and in the presence of a low concentration of the oxidising agent.

As described in GB-A-2284702, organic acid is allowed to react completely with the metal object.

SUMMARY OF THE INVENTION

According to the present invention, there is provided a process for the decontamination of radioactively contaminated metal which comprises contacting the metal with a decontamination reagent solution containing an organic acid and an oxidising agent, allowing said solution to react with the contaminated metal at a pH of up to 4.5, treating the resultant solution to cause substantially complete precipitation of dissolved metal together with radionuclides and separating precipitated material, containing radioactive contaminants, from said solution.

By precipitating substantially all the dissolved metal, a high proportion of radionuclides will also enter the solid phase, either by co-precipitation or adsorption or both. Adsorption will take place into the precipitated metal which, in the case where the contaminated metal is iron or steel, will be mainly in the form of ferric hydroxide.

In a method according to the present invention, the pH of the solution is carefully controlled during the decontamination process, in particular so as not to allow the pH to rise above 4.5, preferably no greater than 3. As a result, the formation of unwanted by-products (such as soluble hydroxides and mixed ternary complexes which may interfere with subsequent process stages) is reduced. A rapid and controllable decontamination reaction is promoted by the reservoir of substantially unreacted acid. Removing the contaminated substrate at a low pH and allowing the solution to reach equilibrium results in a large percentage of the total organic acid not being bound to any metal ion in solution. Contrary to the approach taken in U.S. Pat. No. 5386078, mentioned above, decontamination is terminated at a point when the acid is very far from exhaustion or stoichiometric depletion. In general, reaction between the solution and the contaminated metal is allowed to take place up to a pH at which the metal ions approach their limit of solubility. This is often found to be in the region of pH 3, particularly with metals such as iron and lead. For other metals, the appropriate termination point might be as high as pH 4.5.

A further advantage of the large remaining fraction of organic acid is that it is available to complex any unexpected increase in the metal ions in solution and thus will prevent them catalysing the destruction of the oxidising agent.

Preferably the reaction between the solution and the metal is ceased at a pH between 2.8 and 3.0.

Preferably the reaction is ceased by separating the metal from the solution.

The organic acid may be, for example, formic acid, acetic acid, trifluoroacetic acid, citric acid or oxalic acid or a mixture thereof. A preferred acid is formic acid. Preferably, the organic acid is used in an initial concentration of up to 7.5%, more preferably from 2.5% to 5.0%. It is typically present in an aqueous solution. The solution may include another solvent.

The oxidising agent may be present in the solution from the start of the reaction with the metal but is preferably added continuously or incrementally during the reaction process. The oxidising agent may be, for example, potassium permanganate or a peroxide such as hydrogen peroxide. A preferred oxidising agent is hydrogen peroxide. Preferably, the oxidising agent is present in the solution at up to 1% of the said solution, more preferably about 0.5%.

After the reaction between the solution and the metal has been caused to cease. the precipitation of substantially all of the dissolved metal is effected by any suitable process. For example, a mineral acid may be added which will cause metal precipitation and organic acid regeneration. Alternatively, the pH may be raised by any suitable means. For instance, hydrogen peroxide can be added to the solution to destroy remaining organic acid.

In the process of the present invention, there is typically produced a polyelectrolyte metal hydroxide floc at a low pH. This floc may be formed after ceasing the reaction between the solution and the metal during the raising of the pH. Alternatively, the floc may at least begin to form during the reaction between the solution and the metal substrate.

By having at least some floc present in the solution from a relatively low pH up to and including the final pH, it is possible to remove a range of radionuclides from the solution by surface adsorption and/or co-precipitation. Different radionuclides are differently adsorbed and/or co-precipitated at different pH values. By way of examples, ruthenium achieves its highest percentage removal at a pH of approximately 4.7 and manganese at a pH of approximately 7.5.

By ceasing reaction between the solution and the metal at a pH no greater than 3, only about 20% of the stoichiometric capacity of the organic acid for metal ions is utilised. Since the organic acid is preferably used with a low initial acid concentration of less than 5% wt/vol, typically 2.5% wt/vol, the acid wastage is not costly in the context of the process as a whole. In the case where formic acid is used, no liquid effluents are generated and the only waste produced is a metal hydroxide solid together with the associated radionuclides. Accordingly, there is no prohibitive cost burden associated with utilisation of only 20% of the stoichiometric capacity of the acid.

Where the oxidising agent is added during the reaction between the solution and the metal, it is preferred that it is added in a low concentration. Where an aqueous solution of hydrogen peroxide is added, the concentration is typically up to 1% by volume and preferably about 0.5% by volume. Competing reactions take place in the solution. On the one hand, formyl radicals are formed by interaction between the formic acid and the hydrogen peroxide. The formyl radicals then corrode the metal by an initial reaction to form ferric formate. On the other hand, the formic acid reacts with the hydrogen peroxide to form carbon dioxide and water and is consequently unavailable for metal dissolution and complexation. If the oxidising agent is added at too high a rate, formic acid destruction to form carbon dioxide dominates and little metal surface dissolution (and hence decontamination) is achieved before the acid is completely destroyed. In addition to the ineffective decontamination resulting therefrom, a low concentration of metal ions in solution leads to relatively ineffective adsorption of radionuclides. A ferric hydroxide precipitate of $1.0\times10^{-2}$ mol $dm^{-3}$ achieves substantially complete adsorption of manganese at a pH of approximately 7.5 and substantially complete adsorption of ruthenium at a pH of approximately 4.7. Lowering the ferric hydroxide concentration to $1\times10$ mol $dm^{-3}$ decreases the percentage of adsorption from manganese at a pH of 9.1 to 80% and ruthenium at pH 5.0 to 35%. Some radionuclides, for example caesium, are not particularly effectively removed from solution by ferric hydroxide. The efficiency of caesium removal can be increased by the addition of carrier ions, for example calcium. The preferred form in which calcium is added to the solution is calcium oxalate. This material does not increase the chemical complexity of the solution as the oxalate will be destroyed by the oxidising agent, forming first the formate and then carbon dioxide and water. The calcium is removed by filtration as hydroxide.

After precipitation, the precipitate and associated contaminants are separated from the solution and may be encapsulated for disposal. Fresh organic acid may be added to the solution and the replenished solution may be re-used for decontaminating further metallic materials.

Although iron has been referred to above, the present invention is applicable to other metal substrates including, for example, lead and aluminium.

DESCRIPTION OF PREFERRED EMBODIMENTS

EXAMPLE 1

In this example, a process in accordance with the present invention is used as a pre-treatment of contaminated iron or steel material. In practice. such treatment would be followed by a more aggressive decontamination process.

Twenty coupons were plasma are cut from a contaminated slug bucket. The average coupon size was 70 cm×60 cm×0.3 cm and the average mass was 200 g. Contamination levels were a few hundred counts per minute on the clean side and 3,000–18,000 counts per minute on the contaminated side.

The coupons were contacted with an aqueous solution of 5% formic acid and 0.5% hydrogen peroxide by volume was added every 15 minutes. The volume of the solution was about 1 liter and it was located in a glass reaction vessel fitted with a condenser and heated to 80° C. on a thermostatically controlled hotplate. The coupons were introduced into the solution for 10 minutes each and the weight loss and decontamination factor were recorded for each coupon. The results were shown in Table 1.

Between coupon 12 and coupon 13 the pH solution was measured at 2.8. After the removal of coupon 20 the pH was measured at 3. Prior to the introduction of the first coupon, the pH was about 1. The decontamination factor varied between 1.2 and 2 but did not show any particular decline with increasing pH. At pH 2.8, a slight brown suspension of ferric hydroxide was evident. By pH 3 a heavy ferric floc had precipitated. The precipitate had the effect of coating the coupons with contaminated ferric floc, as the iron removed from the coupon immediately formed hydroxide in solution and coated the surface.

TABLE 1

| | Weight | | Contamination | | | | | Weight |
|---|---|---|---|---|---|---|---|---|
| | | | Before | | After | | | |
| Coupon | Before (g) | After (g) | Side A (CPM) | Side B (CPM) | Side A (CPM) | Side B (CPM) | DF | Loss (g) |
| 1 | 200.69 | 200.21 | 500 | 5000 | Zero | 2500 | 2.00 | 0.48 |
| 2 | 159.81 | 159.64 | 500 | 2500 | Zero | 1200 | 2.08 | 0.17 |
| 3 | 195.09 | 195.05 | 600 | 4000 | Zero | 2200 | 1.82 | 0.04 |
| 4 | 187.78 | 187.57 | 100 | 6000 | Zero | 2800 | 2.14 | 0.21 |
| 5 | 192.06 | 191.99 | 200 | 4000 | Zero | 2500 | 1.60 | 0.07 |
| 6 | 220.30 | 220.23 | 100 | 4000 | Zero | 2200 | 1.82 | 0.07 |
| 7 | 227.50 | 227.29 | 100 | 4000 | Zero | 2500 | 1.60 | 0.21 |
| 8 | 148.54 | 148.32 | 100 | 3000 | Zero | 2000 | 1.50 | 0.22 |
| 9 | 180.90 | 180.79 | 100 | 4000 | Zero | 1600 | 2.50 | 0.11 |
| 20 | 211.19 | 211.08 | 100 | 12000 | Zero | 8000 | 1.50 | 0.16 |
| 11 | 195.97 | 195.81 | 100 | 18000 | Zero | 900 | 2.00 | 0.16 |
| 12 (pH 2.8) | 197.12 | 196.91 | 100 | 14000 | Zero | 900 | 1.56 | 0.21 |

TABLE 1-continued

| | Weight | | Contamination Before | | Contamination After | | | Weight |
|---|---|---|---|---|---|---|---|---|
| Coupon | Before (g) | After (g) | Side A (CPM) | Side B (CPM) | Side A (CPM) | Side B (CPM) | DF | Loss (g) |
| 13 | 143.21 | 143.17 | Zero | 5000 | Zero | 3500 | 1.43 | 0.04 |
| 14 | 155.82 | 155.45 | Zero | 4000 | Zero | 3000 | 1.33 | 0.37 |
| 15 | 171.01 | 170.95 | 100 | 4000 | Zero | 1800 | 2.22 | 0.06 |
| 16 | 147.64 | 147.48 | Zero | 8000 | Zero | 3000 | 2.67 | 0.06 |
| 17 | 225.17 | 225.14 | Zero | 2000 | Zero | 1200 | 1.67 | 0.03 |
| 18 | 228.15 | 228.12 | Zero | 6000 | Zero | 5000 | 1.20 | 0.03 |
| 19 | 227.88 | 227.85 | Zero | 5000 | Zero | 2500 | 2.00 | 0.03 |
| 20 (pH 3) | 234.09 | 234.10 | Zero | 3500 | 100 | 1800 | 1.67 | +0.01 |

At pH 3, decontamination was stopped and an excess of hydrogen peroxide was added to the solution to destroy the remaining formic acid and bring the solution up to pH 7. The radionuclides and heavy metals co-precipitated as hydroxides or were adsorbed onto the surface of the hydroxide. The efficiency of radionuclide removal by the floc was compared at pH 3 and pH 7 and the results given in Table 2.

Accordingly, there is a benefit in utilising the adsorption of radionuclides at pH 3 to decontaminate the solution.

After filtering and removal of the precipitate, fresh formic acid is added to replace the acid consumed during the decontamination process. The replenished solution is then re-used for decontaminating other components. This process can be repeated until radionuclide levels in the acid become excessive, at which point excess hydrogen peroxide is added to drive the pH up to pH 7 where a near 100% sorption and removal of heavy metals and radionuclides is achieved. Water remains and this is used to make up the next batch of formic acid.

TABLE 2

| Radionuclide | % Sorption at pH 3 | % Sorption at pH 7 | Total % Sorption |
|---|---|---|---|
| $Na^{22}$ | 38 | 48 | 100 (86) |
| $Co^{60}$ | 10 | 43 | 60 (53) |
| $Cs^{137}$ | 0 | 51 | 90 (51) |
| $Eu^{152}$ | 36 | 43 | 100 (79) |
| $Du^{154}$ | 36 | 22 | 100 (58) |
| $Th^{234}$ | 33 | 70 | 100 (103) |
| $An^{241}$ | 0 | 24 | 100 (24) |

In this example an oxidative organic acid process is carried out which generates virtually no liquid effluents. The only waste which is generated is the solid comprising metal hydroxides contaminated by radionuclides. This solid may be readily stabilised in a cementaceous grout which is suitable for long-term disposal of radioactive waste.

EXAMPLE 2

Lead samples were obtained by cutting up 6 mm thick contaminated lead sheeting into coupons (with a size of 10 mm×80 mm). Monitoring showed βγ contamination ranging from 300 to 2000 counts/sec (cps).

The apparatus used consisted of a reaction flask standing on a hotplate, the flask lid having attached to it a thermometer to monitor temperature. In addition, two condensers reduce evaporation losses and the lid also includes a sample point for the removal of liquor samples and pH measurements.

Three lead coupons were placed into the reaction flask which contained 1 liter of an aqueous solution containing 2.5% formic acid and 0.5% hydrogen peroxide. The temperature of the solution was 80° C. The lead coupons were removed after 30 minutes to monitor both the activity on the coupons and the pH of the solution.

When the solution reached a pH of 3, the coupons were removed and hydrogen peroxide was added continuously over a period to raise the pH to 7. Samples were taken from the solution at pH values 3, 4, 5 and 7 and the samples were analysed to determine lead concentration. The results are shown in Tables 3 and 4. Table 3 shows the reduction in activity for each coupon as a result of the thirty-minute exposure to the formic acid/hydrogen peroxide solution during which the pH was up to 3. Table 4 shows how the lead concentration in the resulting solution dropped dramatically above pH 4 due to precipitation of lead hydroxide from the solution.

TABLE 3

| TIME (minutes) | Coupon 1 Side A | Coupon 1 Side B | Coupon 2 Side A | Coupon 2 Side B | Coupon 3 Side A | Coupon 3 Side B |
|---|---|---|---|---|---|---|
| 0 | 1496 | 890 | 1131 | 845 | 1067 | 737 |
| 30 | 76 | 42 | 53 | 50 | 80 | 70 |

All results are Total β in cps.

pH of solution after 30 minutes=3.

TABLE 4

| pH | LEAD CONCENTRATION mg/ml |
|---|---|
| 3 | 11 ± 0.1 |
| 4 | 12 ± 0.1 |
| 5 | 0.6 ± 0.1 |
| 7 | 0.7 ± 0.1 |

EXAMPLE 3

Cartridge Cooling Pond (CCP) skips used at Hunterston "A" power station in the UK are contaminated mainly with $Sr^{90}$ which is located in a silicate coating and also in a mixed silicate/aluminium hydroxide layer underneath. Samples of a contaminated skip were used in the present example. They consisted of "egg box" sections of approximately 12 sq cm and channel sections approximately 5 cm long. These were subsequently cut into smaller sections. An initial examination showed radiation levels of up to 4 mSv βγ and 0.4 mSv γ.

The surface of the metal had a dark brown coating that flaked off in places to reveal a verv corroded surface in the case of the egg box sections and a pitted but relatively clean surface on the channel sections. The dark brown coating is a silicate layer that formed after sodium silicate was added to the pond water to inhibit corrosion but which has trapped in it a large amount of activity. Below this is a mixture of silicate and aluminium corrosion products, also contaminated with $Sr^{90}$.

The instruments used to determine activity on the samples were Electra/BP4 for higher levels of the contamination followed by Frisking probes when activity dropped below the background levels for the Electra/BP4. The minimum level of By activity detectable using a frisking probe is 0.25 of a daily working limit (DWL) which equates to 1.25 $Bq/cm^2$. This level is above that of 0.4 Bq/g that is required for free release.

The following trials were conducted, in each case using a decontamination procedure substantially as described in Example 2 and with an operating temperature of 80° C.

Trial 1

This trial was carried out on an egg box section having one side predominantly covered in a silicate layer. After 4 hours the silicate layer was still present. All other surface contamination was removed within the first hour. The contamination remaining was of the order of 10,000 cps (Electra/BP4).

Trial 2

This trial was carried out on a ¼ part of a channel section which was scraped to remove silicate layer. Much of the corrosion layer remained. Before scraping, the contamination was above 70,000 cps(Electra/BP4). After scraping, the sample was 22,000 cps(Electra/BP4). After 1 hour of decontamination by a process of the invention the sample was visibly clean after rinsing. Subsequent monitoring showed levels of contamination below limits of detection on available instrument.

Trial 3

This was carried out on a ¼ part of a channel section. Initial Beta/Gamma readings were again above 70,000 cps (Electra/BP4). After 1 hour of the process of the invention, the surface was visibly cleaner, contamination remaining in the corrosion pits and on that part that had a thick silicate layer present. Contamination was at this stage down to 6,000 cps(Electra/BP4). A further 2 hours in the treatment solution removed all visible contamination except for some remaining on the area occupied by the thick silicate layer which itself had by this time fallen off. Due to the high background radiation there is no contamination level for this stage but it is unlikely to be much below 6,000 cps(Electra/BP4). After filtering the solution, 1 hour in the solution resulted in contamination levels of 200 cps(Electra/Bp4). A further hour in the solution reduced the levels of contamination below limits of detection on available instruments. The total time in the solution amounted to 5 hours.

Trial 4

This was carried out on an egg box section with a loose silicate layer present. The sample was rinsed with a wash bottle, thereby removing the entire silicate layer leaving the underlying corrosion contamination present. Contamination levels after rinsing were 30,000 cps(Electra/BP4). After 1 hour in the solution the sample was visibly clean except for several spots of silicate layer that had not been removed by the water spray. Contamination levels were 5,000 cps (Electra/BP4). After filtering the solution to remove particles of silicate and corrosion products that may have carried on reacting with the solution, 1 hour in the solution resulted in contamination levels of 1,000 cps(Electra/BP4). Silicate was visible in the corrosion pitting. The samples was returned to the solution for another hour, after which contamination was 200 cps(Electra/BP4). A further hour in the solution resulted in levels of contamination below limits of detection on available instruments. The total time in the solution amounted to 4 hours.

Trial 5

The solution used in the above trials had been exposed to the contamined items for a total of 11 hours (2 hours of the total treatment times carried out using a different solution). The solution was filtered to remove coarse particles, sampled for analysis, then destroyed by the addition of 200 mls/liter of 30% hydrogen peroxide. The solution was then filtered on an 11 micron filter paper and the filtrate analysed, the following results being obtained.

| Activity (Bq/ml) | removal | Before destruction | After destruction and filtration |
|---|---|---|---|
| Total alpha | | 65.9 ± 3.53 | 2.70 ± 0.742 |
| Total beta | | 2410 ± 52.4 | 568 ± 26.0 |
| Gamma scan - $Cs^{137}$ | | 162 ± 5.35 | 138 ± 4.88 |
| - $Zr^{95}$ | | 2.00 ± 1.02 | 0 |

The following Trials 6 to 14 illustrate the use of alternative decontamination and represent comparative examples.

Trial 6

A solution containing 0.01 M HCl at 80° C. had no effect on an aluminium coupon.

Trial 7

A combination of 0.01 M HCl and 0.5% $H_2O_2$ at 80° C. was used on an aluminium channel section. The following results were obtained.

| Time | weight (g) | Beta Gamma Activity (cps(Electra/BP4)) |
|---|---|---|
| 0 hour | 197.878 | 67,000 |
| 1 hour | 197.576 | 56,000 |
| 2 hours | 197.436 | 53,000 |
| 3 hours | 197.507 | 52,000 |

These results are regarded as poor. Calculations gave a maximum aluminium loading of 0.5g/l, a pH of 6 and an effectively exhausted solution.

Trial 8

Trial 7 was repeated but with the concentration of HCl increased to 0.1 M.

Initially no $H_2O_2$ was added and there was no visible reaction. Then 5% $H_2O_2$ was added and the following results were obtained.

| Time (hours) | pH | $H_2O_2$ conc. (mg/l) | weight (g) | Beta Gamma activity (cps(Electra/BP4)) | Comments |
|---|---|---|---|---|---|
| 0 | | | 197.507 | 52,000 | |
| 0.5 | | 5 | 195.477 | 26,000 | |
| 1.0 | 2.5 | 3 | 195.304 | 26,000 | |
| 1.5 | 3.5 | 0 | 195.203 | 26,000 | Grey oxide layer formed, 0.5% $H_2O_2$ added |
| 2.0 | 3.5 | 0 | 195.204 | 25,000 | 0.5% $H_2O_2$ added |
| 2.5 | 4.0 | 0 | 194.879 | 23,000 | 0.5% $H_2O_2$ added |

With less than 3g/l of aluminium, the solution was exhausted. The liquor was taken to pH 6 with 30ml of 23% NaOH. It was then filtered on a 5 micron filter. A brown gelatinous precipitate was retained on the filter. This is likely to be the silicate layer. 8.4 ml of conc. HCl were added to the solution to bring the solution back to 0.1 M. This resulted in a white precipitate forming. The solution was disposed of and a fresh solution was made up. The following results were obtained.

| Time (hours) | pH | $H_2O_2$ conc. (mg/l) | weight (g) | Beta Gamma activity (cps(Electra/BP4)) | Comments |
|---|---|---|---|---|---|
| 0 | 0.0 | | 194.879 | 23,000 | |
| 0.5 | | | 193.861 | 15,500 | |
| 1.0 | 4.0 | 0 | 193.733 | 14,600 | 8.4 ml HCL, 15 ml $H_2O_2$ added |
| 1.5 | 3.5 | 1 | 191.648 | 8,350 | 8.4 ml HCL, 15 ml $H_2O_2$ added |
| 1.5 | 1.5 | 1000 | | | 8.4 ml HCL added |
| 1.5 | 0.0 | | | | |
| 2.6 | 4.0 | 0 | 189.924 | 3,750 | 15.4 ml Hcl added |
| 2.6 | 0.5 | | | | |
| 3.6 | 3.5 | 0 | 187.888 | 1,700 | |

Trial 9

A new section of aluminium channel was immersed in 2 liters of 5% HCl and 0.5% $H_2O_2$ at room temperature (22° C.). The section was placed in the solution so that all contaminated surfaces were vertical. The following results were obtained.

| Time (hours) | $H_2O_2$ conc. (mg/l) | weight (g) | Beta Gamma activity (cps(Electra/BP4)) | Comments |
|---|---|---|---|---|
| 0 | | 209.999 | 50,000 | |
| 0.5 | 3 | 206.870 | 6,3000 | 0.5% $H_2O_2$ added |
| 1.0 | 5 | 204.743 | 5,2000 | 0.5% $H_2O_2$ added |
| 1.5 | | 203.098 | 4,900 | Trial stopped |

Trial 10

A new section of aluminium channel was immersed in 1 liter of 0.1 M $HNO_3$ at 80° C. The following results were obtained.

| Time (hours) | pH | weight (g) | Beta Gamma activity (cps(Electra/BP4)) | Comments |
|---|---|---|---|---|
| 0 | 0.0 | 192.498 | 60,000 | |
| 0.5 | 0.0 | 191.264 | 21,800 | |
| 1.0 | | 190.723 | 21,800 | 0.5% $H_2O_2$ added |
| 1.5 | 1.0 | 190.324 | 14,700 | 0.5% $H_2O_2$ added |
| 2.0 | 3.4 | 190.029 | 8,800 | 20 ml of 5 M $HNO_3$ added (0.1 M) |
| 2.5 | 0.0 | 189.546 | 3,750 | |
| 3.0 | 0.5 | 189.948 | 2,200 | |
| 3.5 | 2.0 | 188.948 | 1,600 | |

Trial 11

The channel section from Trial 9 was immersed in 1N NaOH at 22° C. The following results were obtained.

| Time (hours) | weight (g) | Beta Gamma activity (cps(Electra/BP4)) |
|---|---|---|
| 0 | 203.098 | 4,900 |
| 0.5 | 201.285 | 4,060 |
| 1.0 | 200.547 | 3,900 |

Trial 12

The channel section from trial 11 was, after thorough rinsing to remove any plated out material, immersed in 500 ml of 10% acetic acid at 22° C. The following results were obtained.

| Time (hours) | Beta Gamma activity (cps(Electra/BP4)) |
|---|---|
| 0 | 3,900 |
| 0.75 | 50 |

The liquor had a pH of 3.0 and was cloudy.

Trial 13

A large section of aluminium channel was immersed in 10% acetic acid with 0.5% $H_2O_2$ at 22° C. The solution was sparged with a compressed air supply. The following results were obtained.

| Time (hours) | Beta Gamma activity (cps(Electra/BP4)) |
|---|---|
| 0 | 70,000 @ 10 cm |
| 1.0 | 70,000 @ 5 cm |

Trial 14

The channel section from Trial 13 plus another large section of channel from a previous trial were placed in a beaker with 4 liters of 2.5% Formic acid and 0.5% $H_2O_2$ at 80° C. After 24 hours the activity had dropped from above 70,000 cps(Electra/BP4) to 150–200 cps(Electra/BP4). Much pitting was apparent with metal grains visible at the bottom of the beaker. The surface of the metal had a dark grey coating that cleared upon addition of 0.5% $H_2O_2$. It is assumed that this coating was aluminium oxide.

Trial 15

The channel sections from Trials 8 and 9 were immersed in 2 liters of 2.5% formic acid and 0.5% $H_2O_2$ at 80° C. The following results were obtained.

| Time (hours) | weight (g) | weight (g) | pH |
|---|---|---|---|
| 0 | 188.948 | 187.888 | |
| 2.4 | 179.712 | 175.801 | 3.55 |

The total weight loss of 21.323 g gave an aluminium loading of 10.661 g/l. This compares to a theoretical loading of 10.8 g/l. The end product of this trial was visibly the same as for Trial 14. 0.5% $H_2O_2$ addition at the end cleared the solution and the surface of the metal.

What is claimed is:

1. A process for the decontamination of radioactively contaminated metal which comprises contacting the metal with a decontamination reagent solution containing an organic acid and an oxidising agent, allowing said solution to react with the contaminated metal at a pH of up to 4.5, treating the resultant solution to cause substantially complete precipitation of dissolved metal together with radionuclides and separating precipitated material, containing radioactive contaminants, from said solution.

2. A process according to claim 1 wherein the solution is allowed to react with the metal at a pH of up to 3.

3. A process according to claim 1 wherein the organic acid is formic acid, acetic acid, trifluoroacetic acid, citric acid or oxalic acid or a mixture thereof.

4. A process according to claim 1 wherein the oxidising agent is hydrogen peroxide.

5. A process according to claim 1 wherein the substantially complete precipitation is effected by raising the pH of the solution to a pH greater than 7.

6. A process according to claim 5 wherein the pH is raised bv addition of hydrogen peroxide.

7. A process according to claim 1 wherein the substantially complete precipitation is effected by addition of a mineral acid.

8. A process according to claim 1 wherein, after precipitation, the precipitate is separated from the solution and encapsulated for disposal.

9. A process according to claim 8 wherein, after separation of the precipitate, fresh organic acid is added to the solution which is then used to treat further contaminated material.

10. A process according to claim 1 wherein the organic acid is used in an initial concentration of up to 7.5%.

11. A process according to claim 10 wherein the organic acid is used in an initial concentration of from 2.5% to 5%.

12. A process according to claim 1 wherein the oxidising agent is added continuously or incrementally during the reaction process.

13. A process according to claim 1 wherein the oxidising agent forms a maximum of 1% of said solution.

14. A process according to claim 13 wherein the oxidising agent forms a maximum of 0.5% of said solution.

* * * * *